US010254037B2

(12) United States Patent
Candeo et al.

(10) Patent No.: US 10,254,037 B2
(45) Date of Patent: Apr. 9, 2019

(54) EVAPORATOR BOX FAN MOUNTING SOLUTION

(71) Applicant: Electrolux Home Products, Inc., Charlotte, NC (US)

(72) Inventors: Marcelo C. Candeo, Anderson, SC (US); Shawn Boiter, Anderson, SC (US); Justin Elgin, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/464,619

(22) Filed: Mar. 21, 2017

(65) Prior Publication Data

US 2017/0276421 A1 Sep. 28, 2017

Related U.S. Application Data

(60) Provisional application No. 62/312,718, filed on Mar. 24, 2016.

(51) Int. Cl.

| | |
|---|---|
| ***F25D 17/06*** | (2006.01) |
| ***F25D 23/00*** | (2006.01) |
| ***F04D 19/00*** | (2006.01) |
| ***F04D 29/66*** | (2006.01) |
| ***F04D 29/60*** | (2006.01) |

(52) U.S. Cl.

CPC ..... *F25D 17/062* (2013.01); *F04D 19/002* (2013.01); *F04D 29/601* (2013.01); *F04D 29/668* (2013.01); *F25D 23/006* (2013.01); *F25B 2500/13* (2013.01); *F25D 2317/0681* (2013.01)

(58) Field of Classification Search

CPC ..... F25D 17/062; F25D 25/02; F25D 27/00; F25D 23/006; F04D 19/002; F04D 29/522; F04D 29/668

See application file for complete search history.

(56) References Cited

U.S. PATENT DOCUMENTS

| | | | |
|---|---|---|---|
| 3,584,469 | A | 6/1971 | Butts |
| 4,598,894 | A | 7/1986 | Johannes |

(Continued)

FOREIGN PATENT DOCUMENTS

| | | |
|---|---|---|
| EP | 2639532 | 9/2013 |
| JP | 09310889 | 12/1997 |

(Continued)

*Primary Examiner* — Melvin Jones

(74) *Attorney, Agent, or Firm* — Pearne & Gordon LLP

(57) ABSTRACT

A fan assembly for a refrigeration appliance includes a fan for circulating air within a compartment of the refrigeration appliance. The fan includes a frame. A housing is provided for mounting the fan. The housing includes a plate with an opening extending through the plate. A plurality of walls extends from a surface of the plate. A first retaining member extends in a direction generally parallel to a surface of the plate and is disposed proximate the opening for hindering movement of the fan in a direction generally perpendicular to a surface of the plate. The plurality of walls and the first retaining member define a pocket for receiving the frame. A vibration damping member is provided for allowing the fan to vibrate relative to the housing and for hindering the transmission of vibrations from the fan to the housing.

19 Claims, 6 Drawing Sheets

(56) References Cited

U.S. PATENT DOCUMENTS

| | | | | |
|---|---|---|---|---|
| 4,807,718 | A | 2/1989 | Lotz | |
| 5,397,950 | A | 3/1995 | Norbury | |
| 6,772,606 | B2 | 8/2004 | Kopf et al. | |
| 7,306,425 | B2 | 12/2007 | Park et al. | |
| 7,317,267 | B2 | 1/2008 | Schmid et al. | |
| 7,637,717 | B2 | 12/2009 | Oh et al. | |
| 7,895,843 | B1 | 3/2011 | Hawkins et al. | |
| 8,850,839 | B2 | 10/2014 | Park et al. | |
| 9,157,442 | B2 | 10/2015 | Liu | |
| 2003/0020120 | A1* | 1/2003 | Ye | H01L 21/823814 257/377 |
| 2006/0039109 | A1* | 2/2006 | Lin | F04D 29/526 361/695 |
| 2008/0087025 | A1 | 4/2008 | McCain et al. | |
| 2015/0322967 | A1 | 11/2015 | Vardar et al. | |

FOREIGN PATENT DOCUMENTS

| | | |
|---|---|---|
| WO | 2011009784 | 1/2011 |
| WO | 2011026745 | 3/2011 |

* cited by examiner

EVAPORATOR BOX FAN MOUNTING SOLUTION

FIELD OF INVENTION

The following description relates generally to a refrigeration appliance, and more specifically to a mounting solution for an evaporator box fan in a compartment of a refrigeration appliance.

BACKGROUND

Conventional refrigeration appliances include an evaporator fan in a compartment of the appliance for conveying air over an evaporator. Due to the cooling requirements of the appliance, the evaporator fan typically runs for long periods of time, and, in some cases, continuously. Fasteners, such as screws, bolts, etc. are sometimes used to mount the evaporator fan proximate to the evaporator. In some instances, the evaporator fan is mounted in a bracket and placed near the evaporator.

The mounting method used with the evaporator fan often causes undesirable vibration and noise during operation. In instances where the refrigeration appliance is a domestic refrigerator, the noise and vibration can be annoying to consumers and/or give the consumer the impression that the refrigeration appliance is poorly designed and/or poorly manufactured.

It is desirable to have a mounting solution that secures the evaporation fan proximate the evaporator in a manner that reduces the transmission of vibration and noise.

SUMMARY

There is provided a fan assembly for a refrigeration appliance that includes a fan for circulating air within a compartment of the refrigeration appliance. The fan includes a frame. A housing is provided for mounting the fan. The housing includes a plate with an opening extending through the plate. A plurality of walls extends from a surface of the plate. A first retaining member extends in a direction generally parallel to a surface of the plate and is disposed proximate the opening for hindering movement of the fan in a direction generally perpendicular to a surface of the plate. The plurality of walls and the first retaining member define a pocket for receiving the frame. A vibration damping member is provided for allowing the fan to vibrate relative to the housing and for hindering the transmission of vibrations from the fan to the housing.

In accordance with another aspect, there is provided a refrigeration appliance for storing articles in a refrigerated environment. The refrigeration appliance includes a first compartment and an evaporator. A fan assembly is provided for supplying cooling air from the evaporator to the first compartment. The fan assembly includes a fan for circulating the cooling air. The fan includes a frame. A housing is provided for mounting the fan. The housing includes a plate with an opening extending through the plate. A plurality of walls extends from a surface of the plate. A first retaining member extends in a direction generally parallel to a surface of the plate and is disposed proximate the opening for preventing movement of the fan in a direction generally perpendicular to a surface of the plate. The plurality of walls and the first retaining member define a pocket for receiving the frame. A vibration damping member is provided for allowing the fan to vibrate relative to the housing and for hindering the transmission of vibrations from the fan to the housing.

DETAILED DESCRIPTION

Figure 1:
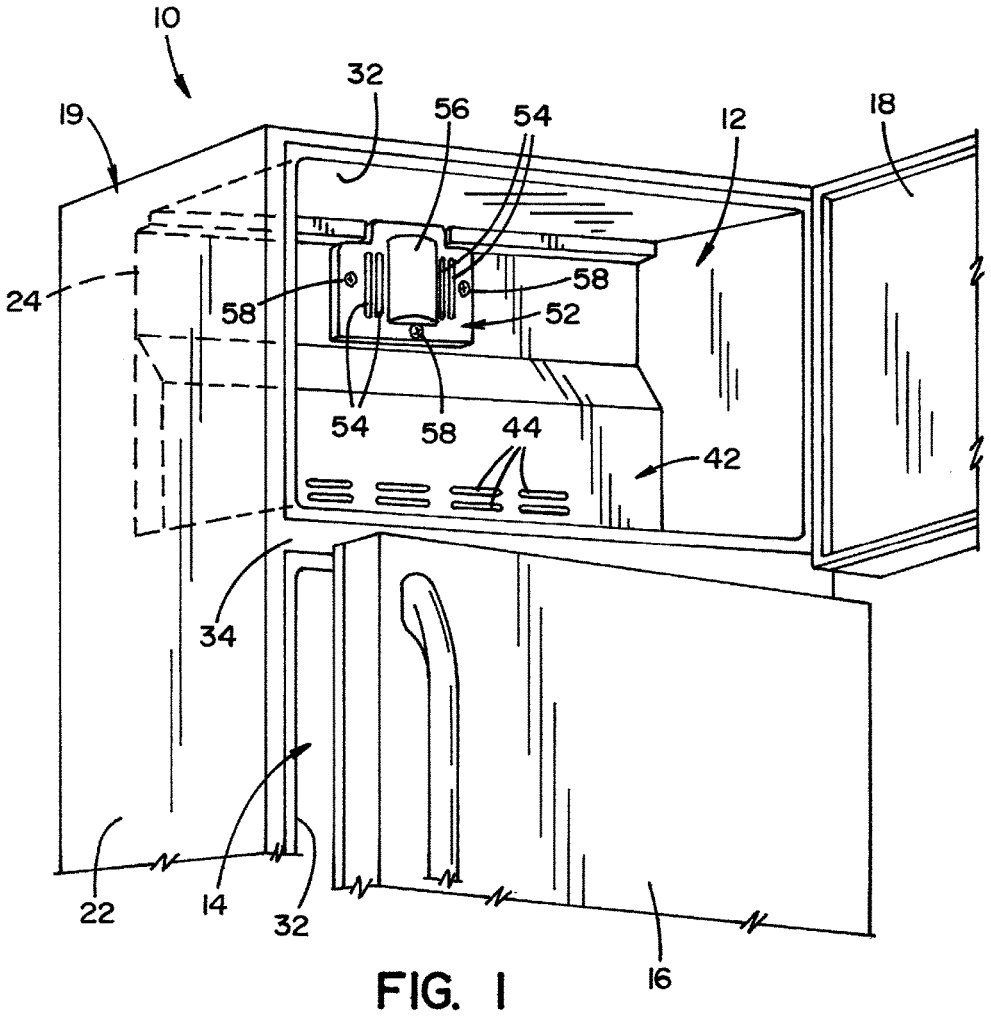
FIG. 1 is a perspective view of a top mount refrigerator showing an evaporator assembly mounted in a back wall of a freezer compartment.

Referring now to the drawings, FIG. 1 shows a refrigeration appliance in the form of a domestic refrigerator, indicated generally at 10. Although the detailed description that follows concerns a domestic refrigerator 10, the refrigeration appliance can be embodied by refrigeration appliances other than with a domestic refrigerator 10. Further, an embodiment is described in detail below, and shown in the figures as a top-mount configuration of a refrigerator 10, including a fresh food compartment 14 disposed vertically below a freezer compartment 12. However, the refrigerator 10 can have any desired configuration including a French door bottom mount refrigerator wherein the freezer compartment is disposed vertically below the fresh food compartment.

While the present application is described herein by way of attaching a fan mounting assembly to an example refrigeration appliance, it is contemplated that the described mounting assembly could also be used in various other appliances, such as stoves, microwaves, stand-alone refrigerators, or freezers, as well as other configurations of combined refrigerator/freezers, air conditioners, and/or any electronic equipment that uses a fan to provide cooling air.

A door 16 is pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors (not shown) that collectively span the entire lateral distance of the entrance to the fresh food compartment 14 to enclose the fresh food compartment 14.

A second door 18 is pivotally coupled to the cabinet 19 of the refrigerator 10 to restrict and grant access to the freezer compartment 12. The door 18 can include a single door that spans the entire lateral distance across the entrance to the freezer compartment 12, or can include a pull-out drawer (not shown) or a pair of French-type doors (not shown).

The refrigerator 10 includes a cabinet shell 22 defined at least in part by first and second upstanding side panels that are interconnected and laterally spaced by a top panel. The cabinet shell 22 can also include a rear panel and an internal reinforcing structure (not shown). A liner 32 inside the cabinet shell 22 can define the fresh food compartment 14 and the freezer compartment 12. Foam insulation can be used between the cabinet shell 22 and the liner 32. Since the refrigerator 10 represents a top mount-type refrigerator, a divider portion 34 is provided which extends laterally across shell 22 and divides the fresh food compartment 14 from the freezer compartment 12. Alternatively, the divider portion 34 can divide the refrigerator 10 into an upper fresh food compartment, and a lower freezer compartment.

A cooling system of a refrigerator typically includes a compressor, a condenser, an evaporator and an expansion valve connected in series. The compressor, the condenser and the expansion valve are well known in the art and are not described in detail in the present application. The cooling system is charged with a refrigerant to draw heat from the freezer compartment 12 and release heat to a surrounding environment.

While the present application is described herein by way of attaching a fan mounting assembly proximate the evaporator of a refrigeration appliance, it is contemplated that the described mounting assembly could also be used in mounting the fan mounting assembly proximate a condenser. The condenser can be disposed in or on the refrigerator appliance, e.g., in a machine compartment such that the fan conveys air over the condenser.

Figure 2:
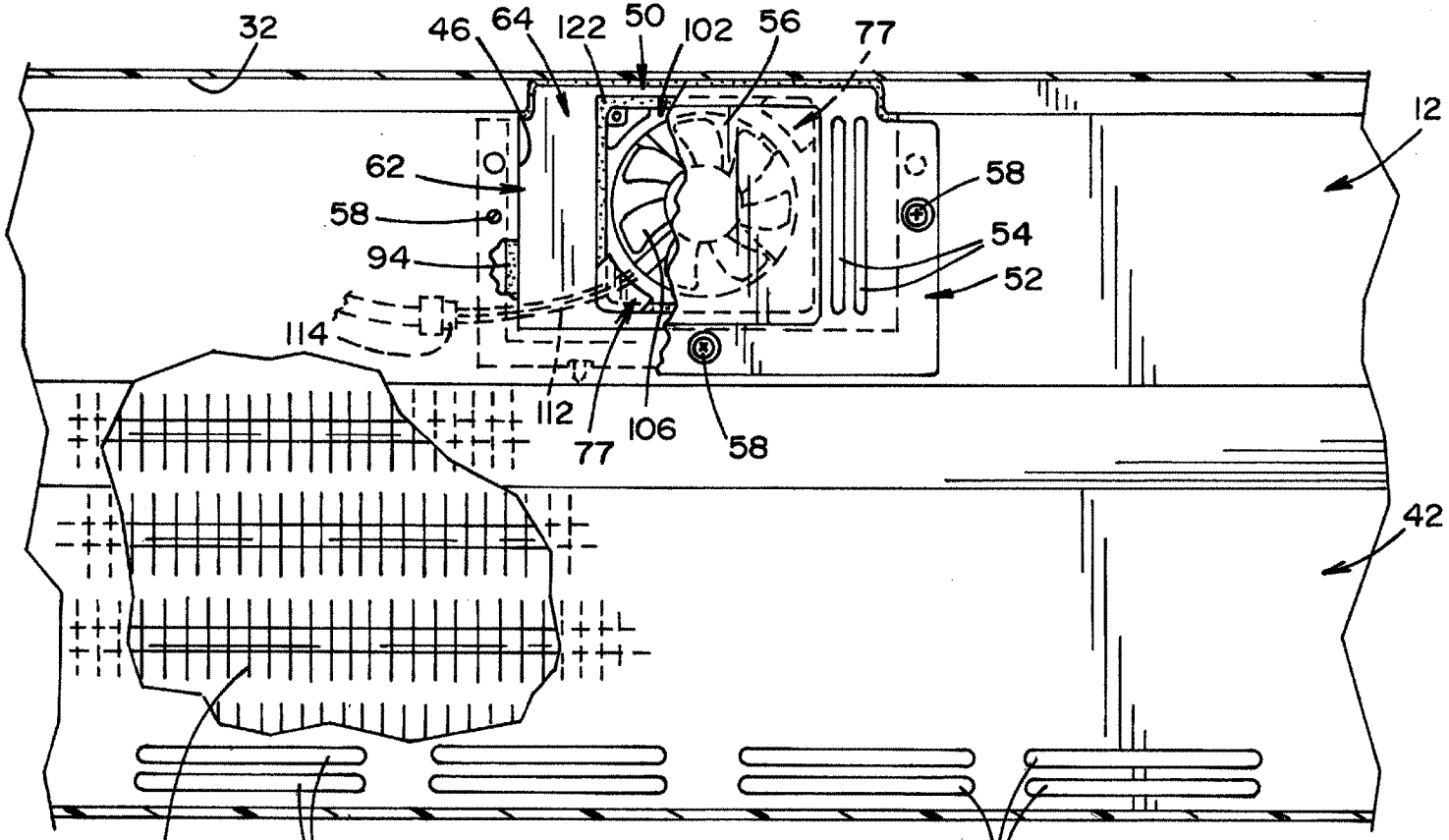
FIG. 2 is a partially sectioned front plan view of the evaporator assembly of FIG. 1 showing an evaporator fan assembly mounted in an upper part of the evaporator assembly.

Referring now to FIG. 2, an evaporator 38 is disposed in a rear of the freezer compartment 12 to draw heat from the freezer compartment 12.

Referring to FIG. 1, the freezer compartment 12 has a rear wall 24. In one embodiment, an evaporator coil cover 42 is spaced from the rear wall 24. The evaporator coil cover 42 can be coupled to the rear wall 24 by any suitable mechanical (e.g., screws, rivets, nuts and bolts, etc.), chemical (e.g., adhesive, epoxy, etc.), or other type of fasteners. Referring to FIG. 2, ventilation slots 44 may be provided in a lower portion of the evaporator coil cover 42 to allow a circulation of air pulled by a fan assembly 50 through the evaporator 38. A fan opening 46 is formed in the evaporator coil cover 42. In the embodiment shown, the fan opening 46 is disposed in an upper portion of the cover 42. An air tower (not shown) may be attached to the lower center area of the evaporator coil cover 42 with a surface facing the interior of the freezer compartment. It is contemplated that the evaporator coil cover 42 can be located inside the fresh food compartment 14.

Figure 5:
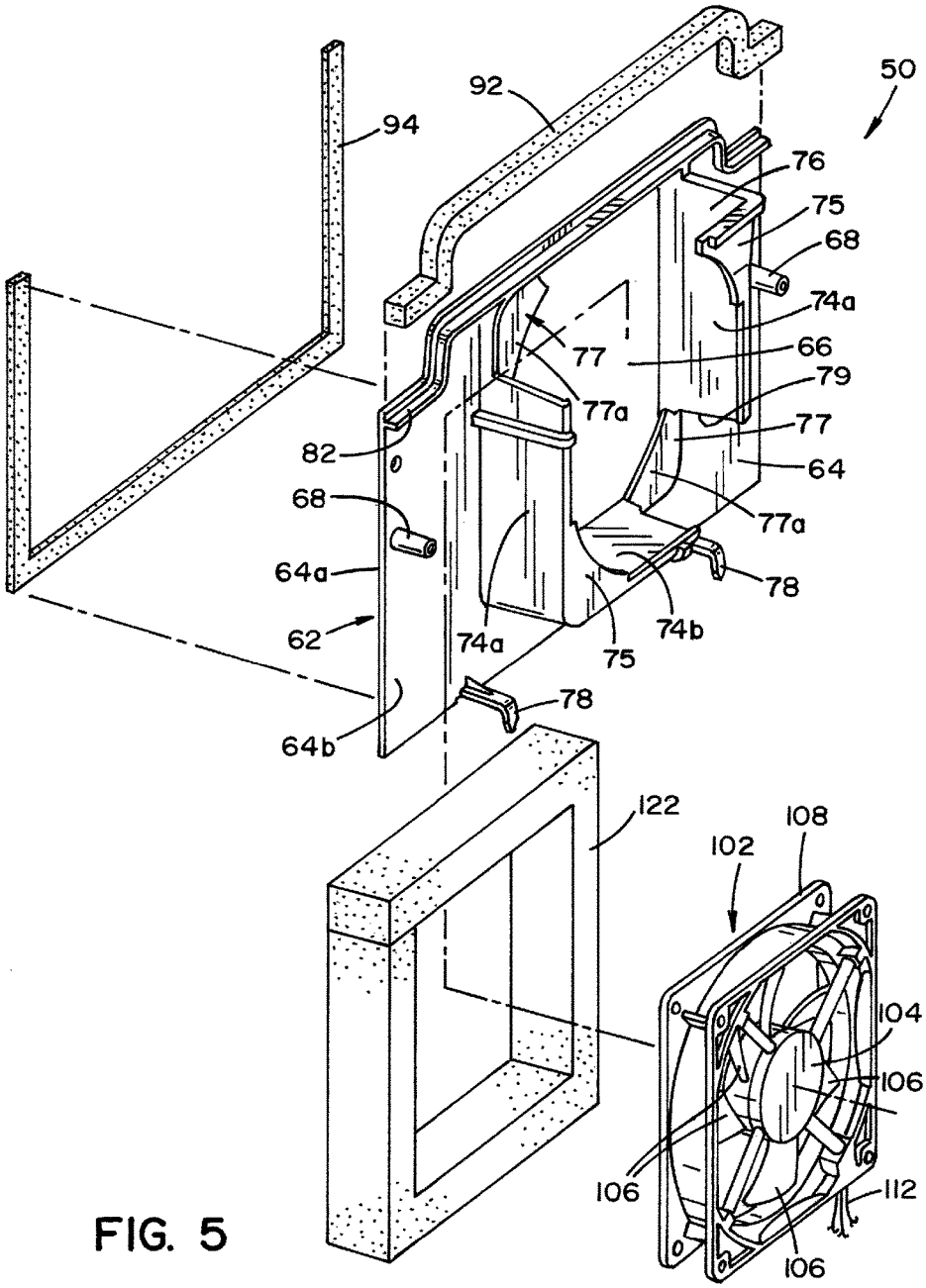
FIG. 5 is an exploded rear perspective view of the evaporator fan assembly of FIG. 2.

The fan assembly 50 is disposed in registry with the fan opening 46 in the evaporator coil cover 42. Referring now to FIG. 5, the fan assembly 50 includes, in general, a housing 62 and a cooling fan 102.

As shown in FIGS. 1 and 2, a cover 52 of the fan assembly 50 is attached to a front surface of the evaporator coil cover 42. The cover 52 includes a plurality of openings 54 for allowing air to pass through the cover 52. In the embodiment shown, the plurality of openings 54 are vertical slots that are disposed on either side of a convex feature 56 formed in a central portion of the cover 52. It is contemplated that the plurality of openings 54 can also be formed as one or more grated openings formed in the cover 52. It is contemplated that the cover 52 can be made from plastic to provide an aesthetically pleasing appearance to a user. The cover 52 may be attached to the evaporator coil cover 42 by any suitable mechanical fasteners 58, such as screws, rivets, nuts, and bolts, for example. Alternatively, the cover 52 may be attached by any suitable chemical fasteners, such as adhesive, epoxy, or other type of fasteners, for example.

Referring now to FIG. 5, the housing 62 includes a plate 64 having an opening 66 extending through a central portion of the plate 64 from a front surface 64*a* to a rear surface 64*b* of the plate 64. In the embodiment shown (see FIG. 3), the opening 66 is generally square in shape and is dimensioned to correspond with the size of the cooling fan 102, described in detail below.

A plurality of bosses 68 extend from the rear surface 64*b* of the plate 64. A plurality of holes 67 extend through the plate 64 and are positioned and dimensioned to align with the plurality of bosses 68. The plurality of holes 67 and the plurality of bosses 68 are dimensioned and positioned to align with the mounting holes in the cover 52, as described in detail below.

Figure 4:
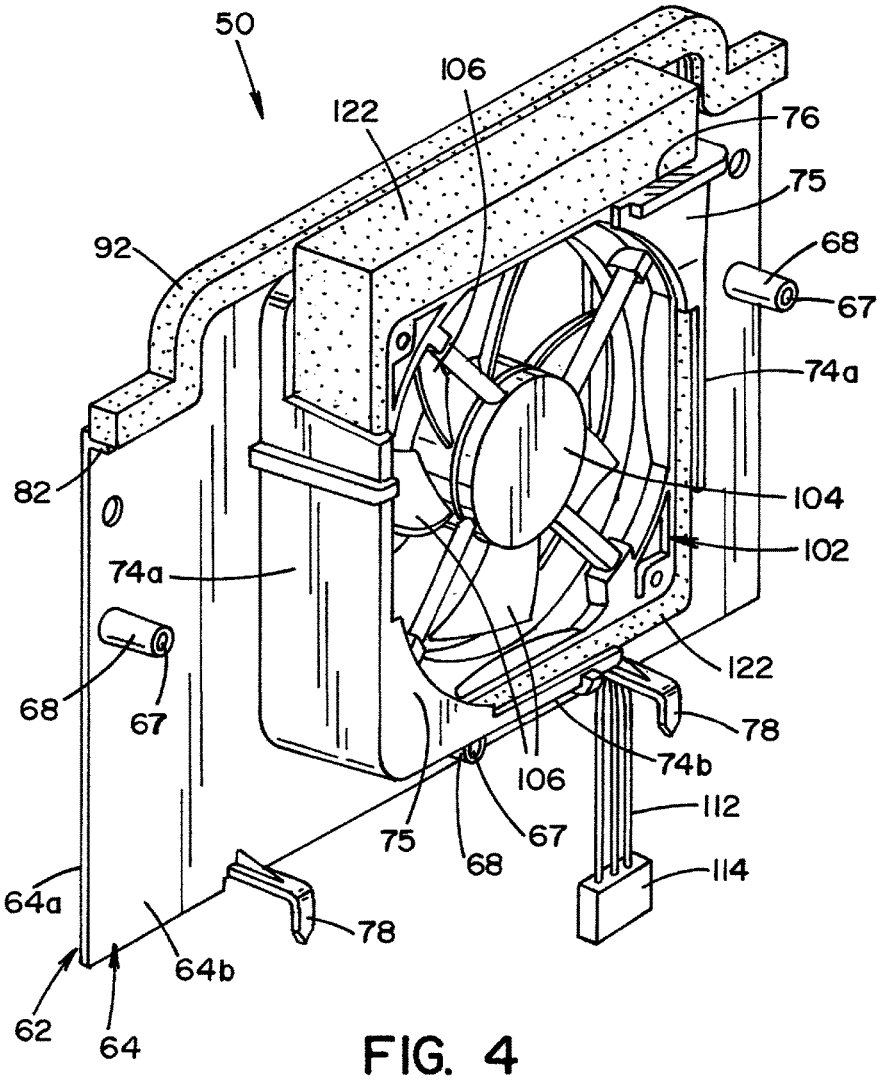
FIG. 4 is a rear perspective view of the evaporator fan assembly of FIG. 2.

Referring to FIG. 4, two opposing side walls 74*a* and a bottom wall 74*b* extend from the rear surface 64*b* of the plate 64 for receiving the cooling fan 102. It is contemplated that the side walls 74*a* and the bottom wall 74*b* can be disposed at approximately 90 degrees to the rear surface 64*b* of the plate 64. Referring now to FIG. 5, the opposing side walls 74*a* define an opening 76 in an upper portion of the housing 62. The opening 76 is dimensioned as described in detail below. In the embodiment shown, retaining members extend inwardly from the opposing side walls 74*a* and the bottom wall 74*b*. The retaining member can be a brace 75. The braces 75 can be formed as triangular braces with one curved side. It is contemplated that the braces 75 can extend from corners where the opposing side walls 74*a* and the bottom wall 74*b* meet or the braces 75 can be formed at the upper end of one or both of the opposing side walls 74*a*.

Figure 6:
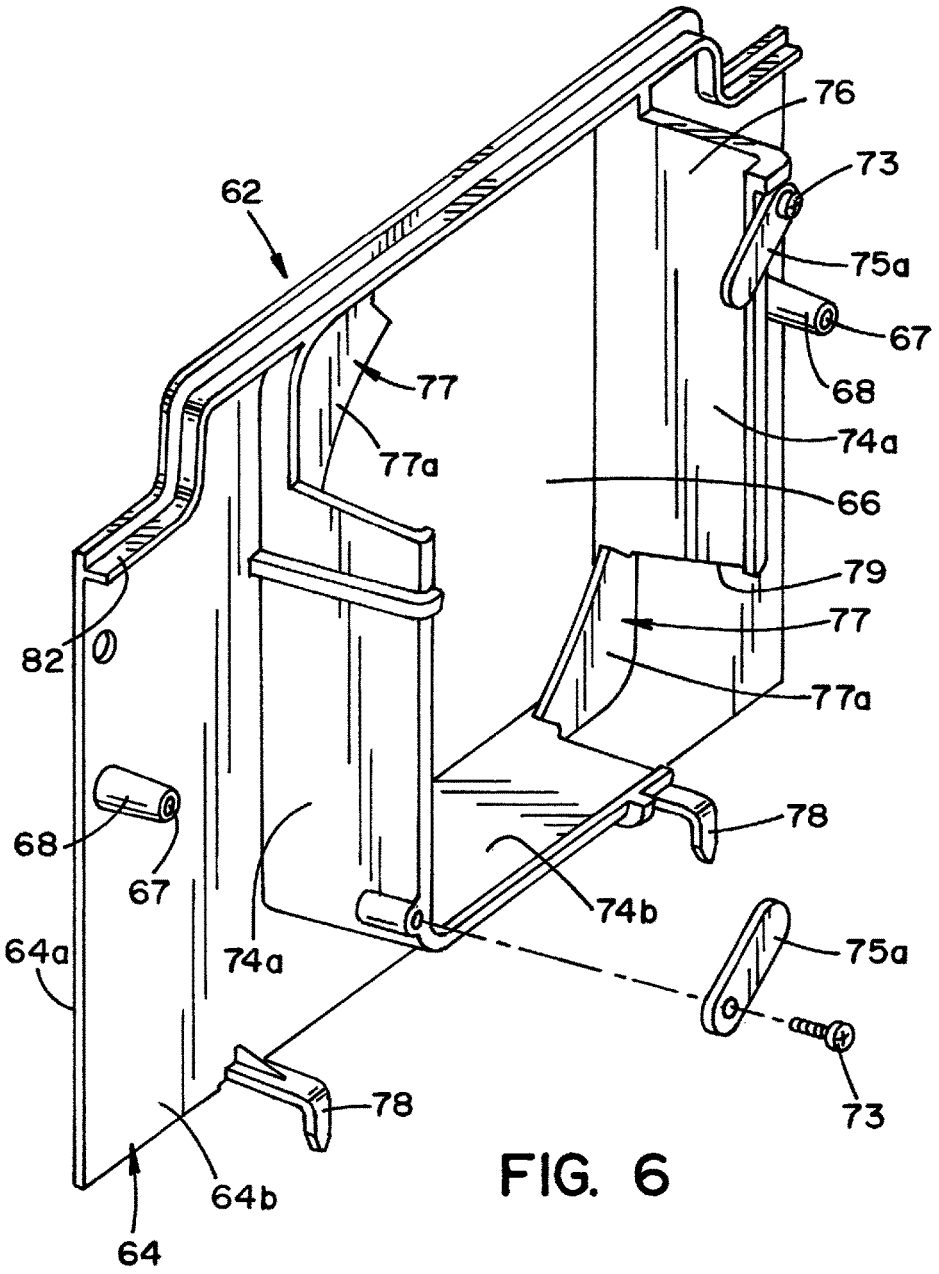
FIG. 6 is an exploded rear perspective view of a frame of the evaporator fan assembly of FIG. 2 showing an alternative embodiment of the frame.

It is also contemplated that the housing 62 can include a top wall (not shown) and one of the opposing side walls 74*a* can be eliminated to define an opening. The cooling fan 102 can then be inserted into the housing 62 through the side of the housing 62. Referring to FIG. 6, it is further contemplated that in this embodiment the retaining members are movable braces 75*a* and can be separate parts that are secured to the housing 62 by fasteners 63. The movable braces 75*a* can be rotated or removed to allow the cooling fan 102 to be inserted through a rear opening of the housing 62. The movable braces 75*a* can then be rotated or reattached to secure the cooling fan 102 in the housing 62.

Referring now to FIG. 5, additional retaining members are formed in the opening 66 in the plate 64. In the embodiment shown, the additional retaining members are tabs 77 that are disposed in diagonally opposite corners of the opening 66. The tabs 77 include a rear surface 77*a* that faces the pocket defined by the opposing side walls 74*a*, the bottom wall 74*b* and the braces 75. The rear surface 77*a* of the tabs 77 are slightly offset from the front surface 64*a* of the plate 64 toward the rear surface 64*b* of the plate 64. The tabs 77 are dimensioned as described in detail below. The opposing side walls 74*a*, the bottom wall 74*b*, the braces 75 and the tabs 77 define a pocket that is dimensioned to accommodate the cooling fan 102, as described in detail below.

A notch 79 is formed in a corner defined by one of the opposing side walls 74*a* and the bottom wall 74*b*. The notch 79 defines an opening that is dimensioned and positioned as described in detail below.

L-shaped tabs 78 extend from the rear surface 64*b* of the plate 64. The L-shaped tabs 78 can be used for positioning the housing 62 in the proper position relative to the evaporator coil cover 42 and/or the rear wall 24, as described in detail below.

A flange 82 extends from the rear surface 64*b* of the plate 64 at a location spaced from the upper edge of the plate 64. The flange 82 is contoured to match the shape of the upper edge of the plate 64. The flange 82 is dimensioned to define a mounting location for an elongated gasket 92.

It is contemplated that the housing 62 can be integrally formed as a monolithic structure through insert molding, for example. It is further contemplated that the housing 62 can be formed of a rigid, semi-rigid, semi-flexible, or flexible plastic material (e.g., an injection molded plastic), such as a thermoplastic polymer like Acrylonitrile butadiene styrene (ABS), for example. As a result, the housing 62 may deform, as needed, to provide a loose fit around the cooling fan 102, as described in detail below.

Figure 3:
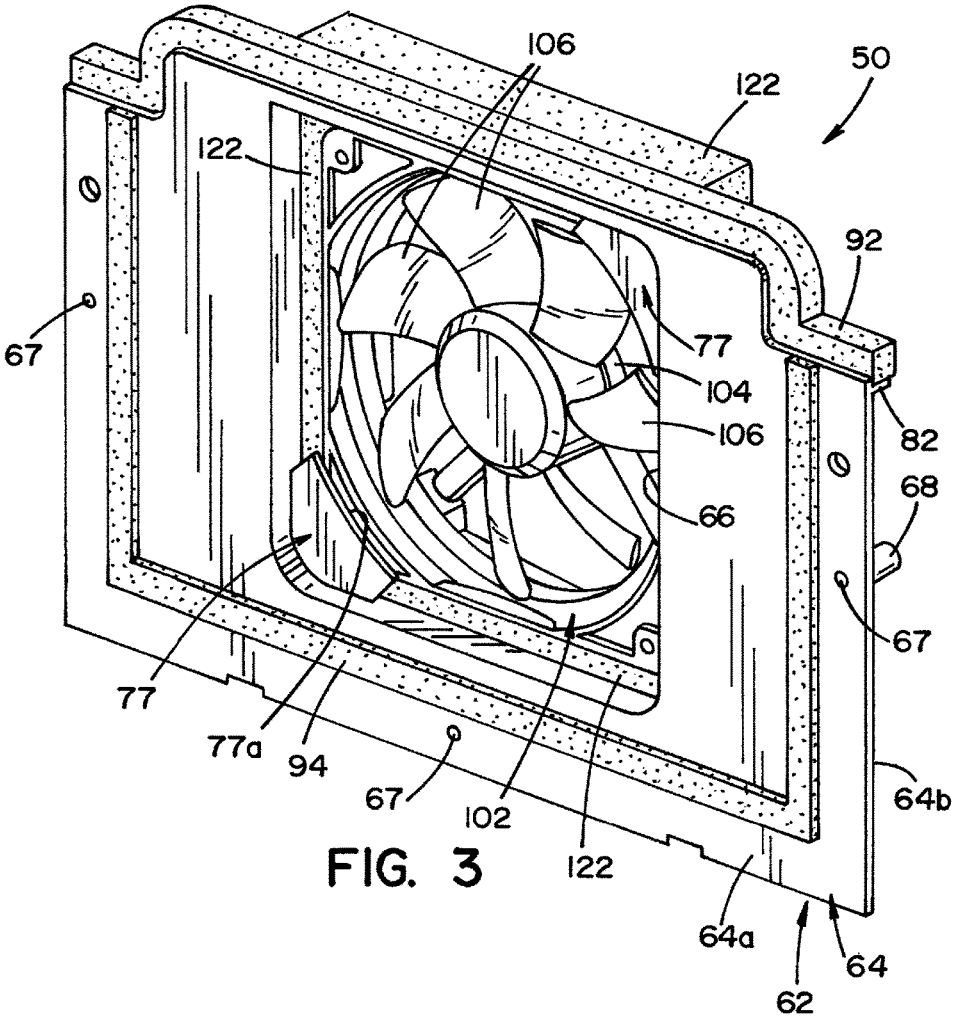
FIG. 3 is a front perspective view of the evaporator fan assembly of FIG. 2.

The elongated gasket 92 has a generally square cross section (when viewed from the end) and is contoured to generally match the contour of the upper edge of the plate 64. The gasket 92 has a lower surface that rests on the flange 82. As shown in FIGS. 3 and 4, the gasket 92 has a height that is greater than the distance between the upper edge of the plate 64 and the flange 82. As shown in FIGS. 3 and 4, the height of the gasket 92 can be selected such that a portion of the gasket 92 extends beyond the upper edge of the plate 64 when the gasket 92 is seated on the flange 82. The gasket 92 can be made of a foam material or any other material suitable for sealing a gap between two surfaces. It is contemplated that the gasket 92 can be overmolded into the plate 64 to reduce the number of parts required during assembly. It is also contemplated that the gasket 92 can be applied to the flange 82 as a fluidic material that is cured or hardened prior to final assembly.

Referring to FIG. 3, a U-shaped gasket 94 is disposed on the front surface 64*a* of the plate 64. In the embodiment shown, the gasket 94 has a rectangular-shaped cross section (when viewed from the end). Similar to the gasket 92, the gasket 94 can be made of a foam material or any other material suitable for sealing a gap between two surfaces. It is contemplated that the gasket 94 can be inserted into one or more slots or holes (not shown) in the front surface 64*a* to secure the gasket 94 to the plate 64. It is also contemplated that an adhesive (not shown) can be used to attach the gasket 94 to the plate 64. It is also contemplated that the gasket 94 can be applied to the plate 64 as a fluidic material that is cured or hardened prior to final assembly.

Referring to FIG. 5, the cooling fan 102 is disposed within the pocket defined on the rear surface 64*b* of the plate 64. The cooling fan 102 includes a motor 104 that rotates a plurality of fan blades 106. A frame 108 is disposed around the motor 104 and the plurality of fan blades 106. In the embodiment shown, the cooling fan 102 is a generally square-shaped box fan. A plurality of wires 112 connects the motor 104 to source of power. A connector 114 (FIG. 4) can be connected to the end of the plurality of wires 112 for allowing quick connection to a mating plug (not shown).

A vibration damping member is providing for allowing the cooling fan 102 to vibrate relative to the housing 62. The vibration damping member can be a gasket 122, i.e., a separate component, that is disposed around the side walls of the frame 108. In the embodiment shown, the gasket 122 is a square frame-shaped component having sides with square-shaped cross sections. It is contemplated that the gasket 122 can be formed as a single component or a plurality of components that are attached together. It is further contemplated that the gasket 122 can be attached to the frame 108 using an adhesive or other attachment means. It is also contemplated that the gasket 122 can be formed as part of the housing 62 or the frame 108 of the cooling fan 102. For example, the gasket 122 can be overmolded into the housing 62 or onto the frame 108. It is also contemplated that the vibration damping member can be a vibration damping material, for example, but not limited to, a coating, a multi-layer material or an expandable foam type material that is applied to at least one of the housing 62 and frame 108 of the cooling fan 102.

It is also contemplated that the gasket 122 can be made of foam fabricated from damping/absorption/isolation materials, such as closed-cell foam materials like EPDM (ethylene propylene diene terpolymer), Ensolite EFO, polyethylene, cellular glass, closed-cell phenolic, flexible elastomeric, polyisocyurante, and polystyrene, for example.

Referring to FIG. 4, in this embodiment the vibration damping member is the gasket 122 that is dimensioned to fit around the side walls of the frame 108 to secure the gasket 122 to the frame 108 while still allow the frame 108 to vibrate, as described in detail below. The gasket 122 and the cooling fan 102 are then inserted into the opening 76 in the housing 62. In particular, the gasket 122 and the cooling fan 102 are received into the pocket defined by the opposing side walls 74*a*, the bottom wall 74*b*, the tabs 77 (FIG. 3) and the braces 75. The opposing side walls 74*a* and the bottom wall 74*b* are dimensioned to hold the gasket 122 and the cooling fan 102. It is contemplated that the retaining members, e.g., braces 75, removable braces 75*a* and tabs 77 can extend in a direction generally parallel to the surface of the plate 64, i.e., not necessarily exactly parallel, but sufficiently parallel to retain the frame 108 and hinder the cooling fan 102 from moving in a direction perpendicular to the plate 64, i.e., movement including a vector component perpendicular to the plate 64. In the embodiment shown, the rear surfaces 77*a* of the tabs 77 (FIGS. 3 and 5) and the braces 75 are disposed on opposite sides of the gasket 122 and the cooling fan 102 and are configured to retain the frame 108 and hinder the aforementioned movement of the cooling fan 102.

It is contemplated that when the fan 102 is inserted into the pocket of the housing 62 that the tabs 77 (FIG. 3) may slightly flex to allow the gasket 122 and the cooling fan 102 to be properly positioned in the pocket. Once the gasket 122 and the cooling fan 102 are fully seated in the pocket the tabs 77 can snap back to their resting configuration.

The gasket 122 is dimensioned such that there is little or no contact between the cooling fan 102 and any portion of the housing 62. In this respect, the gasket 122 allows the cooling fan 102 to "float" relative to the housing 62. The gasket 122 also is designed to dampen the transmission of vibration and sound from the cooling fan 102 to the housing 62. The gasket 122 may be formed with various thicknesses. However, test results performed by the inventors demonstrate that a thick gasket provides better noise and vibration dampening than a thinner foam gasket.

When the cooling fan 102 is fully seated in the housing 62, the wires 112 from the cooling fan 102 extend through the opening defined by the notch 79. The cooling fan 102 is also positioned to be in registry with the opening 66 in the housing 62. The opening 66 allows the flow of air from the cooling fan 102 into the compartment. Thus, the opening 66 functions as an outlet opening for the air flow circulated by the cooling fan 102.

As described in detail above, the fan 102 is secured to the housing 62 without additional fasteners, which further reduces the noise typically caused by metal fasteners, such as screws, bolts, and nuts, for example. This no-fastener configuration also allows fast and easy assembly by simply dropping or sliding the fan 102 through the opening 76 to the pocket in the housing 62.

Referring to FIG. 2, the fan assembly 50 is then attached to the evaporator coil cover 42. In particular, the gasket 94 on the front surface 64*a* of the plate 64 of the housing 62 abuts against the back surface of the evaporator coil cover 42 to sealingly connect the fan assembly 50 to the evaporator coil cover 42. The gasket 94 also functions as a vibration damper to dampen the transmission of vibration and sound from the housing 62 to the evaporator coil cover 42.

The rear surface 64*b* of the plate 64 may include various features, e.g., tabs 78 (FIG. 4) for coupling the fan assembly 50 to the rear wall 24 of compartment 12 and/or to the evaporator coil cover 42. These features can be formed as internally-threaded posts, arms, or brackets, for example, which may cooperate with mating features in the rear wall 24 and/or the evaporator coil cover 42.

In the embodiment shown, the housing 62 includes a plate 64 that is positioned next to the evaporator coil cover 42. It is contemplated that the two opposing side walls 74*a* and the bottom wall 74*b* of the housing 62 can extend from the rear wall 24 of the compartment 12 or from the rear surface of the evaporator coil cover 42. In these embodiments, the rear wall 24 of the compartment 12 or the evaporator coil cover 42 would replace the plate 64.

Referring now to FIG. 1, the cover 52 of the fan assembly 50 is then secured to the housing 62 using fasteners 58. The fasteners 58 extend through the holes in the cover 52 and the holes 67 in the housing 62 into the bosses 68. In the embodiment shown, the fasteners 58 are screws that thread into the bosses 68 to secure the cover 52 to the housing 62.

As shown in FIG. 2, when the fan assembly 50 is secured to the evaporator coil cover 42, the gasket 92 and the gasket 122 contact surfaces within the compartment 12. The gaskets 92, 122 function to form a seal and to dampen the transmission of vibration and sound from the fan assembly 50 to the surrounding compartment 12.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A fan assembly for a refrigeration appliance, the fan assembly comprising:

a fan for circulating air within a compartment of the refrigeration appliance, the fan including a frame;

a housing for mounting the fan, the housing comprising:

a plate with an opening extending through the plate;

a plurality of walls extending from a surface of the plate;

a first retaining member extending in a direction generally parallel to a surface of the plate and disposed proximate the opening for hindering movement of the fan in a direction perpendicular to a surface of the plate; and a second retaining member wherein one of the first retaining member and the second retaining member is disposed in the opening in the plate and the other of the first retaining member and the second retaining member is attached to one of the plurality of walls, wherein the plurality of walls and the first retaining member define a pocket for receiving the frame; and a vibration damping member for allowing the fan to vibrate relative to the housing and for hindering transmission of vibrations from the fan to the housing.

2. The fan assembly according to claim 1, wherein the plurality of walls includes a horizontal lower wall and two vertical side walls extending from opposite ends of the horizontal lower wall, upper ends of the vertical side walls defining an opening for receiving the fan into the pocket.

3. The fan assembly according to claim 1, wherein the first retaining member is attached to one of the plurality of walls.

4. The fan assembly according to claim 1, wherein the first retaining member is fixed relative to one of the plurality of walls.

5. The fan assembly according to claim 1, wherein the vibration damping member is a gasket made of a closed-cell foam material.

6. The fan assembly according to claim 1, wherein the fan is secured in the housing without additional fasteners.

7. The fan assembly according to claim 1, wherein the vibration damping member is attached to at least one of the frame of the fan and the housing.

8. The fan assembly according to claim 1, wherein the housing is mounted to a wall of the compartment of the refrigeration appliance.

9. The fan assembly according to claim 1, wherein the plate of the housing is a wall of the compartment of the refrigeration appliance.

10. A refrigeration appliance for storing articles in a refrigerated environment, the refrigeration appliance comprising:

a first compartment;

an evaporator; and a fan assembly for supplying cooling air from the evaporator to the first compartment, the fan assembly comprising:

a fan for circulating the cooling air, the fan including a frame;

a housing for mounting the fan, the housing comprising:

a plate with an opening extending through the plate;

a plurality of walls extending from a surface of the plate; and a first retaining member extending in a direction generally parallel to a surface of the plate and disposed proximate the opening for hindering movement of the fan in a direction generally perpendicular to a surface of the plate, wherein the plurality of walls and the first retaining member define a pocket for receiving the frame; and a vibration damping member for allowing the fan to vibrate relative to the housing and for hindering transmission of vibrations from the fan to the housing.

11. The refrigeration appliance according to claim 10, wherein the plurality of walls includes a horizontal lower wall and two vertical side walls extending from opposite ends of the horizontal lower wall, upper ends of the vertical side walls defining an opening for receiving the fan into the pocket.

12. The refrigeration appliance according to claim 10, wherein the first retaining member is attached to one of the plurality of walls.

13. The refrigeration appliance according to claim 10, further comprising a second retaining member wherein one of the first retaining member and the second retaining member is disposed in the opening in the plate and the other of the first retaining member and the second retaining member is attached to one of the plurality of walls.

14. The refrigeration appliance according to claim 10, wherein the first retaining member is fixed relative to one of the plurality of walls.

15. The refrigeration appliance according to claim 10, wherein the vibration damping member is a gasket made of a closed-cell foam material.

16. The refrigeration appliance according to claim 10, wherein the fan is secured in the housing without additional fasteners.

17. The fan assembly according to claim 10, wherein the vibration damping member is attached to at least one of the frame of the fan and the housing.

18. The fan assembly according to claim 10, wherein the housing is mounted to the first compartment.

19. The fan assembly according to claim 10, wherein the plate of the housing is a wall of the first compartment.

* * * * *